US006259344B1

(12) United States Patent
Heritier-Best et al.

(10) Patent No.: US 6,259,344 B1
(45) **Date of Patent: *Jul. 10, 2001**

(54) IGNITION COMPONENT FOR INTERNAL COMBUSTION ENGINES

(75) Inventors: Pierre Heritier-Best, Orbeil; Laurent Coste, Brioude, both of (FR)

(73) Assignee: Sagem SA, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/557,577

(22) Filed: Nov. 14, 1995

(30) Foreign Application Priority Data

Nov. 15, 1994 (FR) ..... 94 13643

(51) Int. Cl.[7] ..... H01F 27/04; H01F 27/02; F02F 11/00

(52) U.S. Cl. ..... 336/96; 336/107; 123/634; 123/635

(58) Field of Search ..... 336/107, 96; 123/634, 123/635, 169 A

(56) References Cited

U.S. PATENT DOCUMENTS

| | | | | |
|---|---|---|---|---|
| 964,007 | * | 7/1910 | England | 123/635 |
| 2,378,893 | * | 6/1945 | Berkey et al. | 123/635 |
| 2,394,768 | * | 2/1946 | Hankness | 123/635 |
| 2,459,856 | * | 1/1949 | Wall | 123/169 PA |
| 2,478,087 | * | 8/1949 | Bychinsky et al. | 123/169 PA |
| 4,277,724 | | 7/1981 | Beeghly . | |
| 4,825,844 | * | 5/1989 | Fasola | 123/635 |
| 4,831,995 | | 5/1989 | Biton . | |
| 5,111,790 | * | 5/1992 | Grandy | 123/635 |

FOREIGN PATENT DOCUMENTS

| | | |
|---|---|---|
| 4130013A1 | 4/1992 | (DE) . |
| 0069889 | 1/1983 | (EP) . |
| 0387993 | 9/1990 | (EP) . |

OTHER PUBLICATIONS

"Research Disclosure" No. 328, Aug. 1, 1991, pp. 626 000217946 "Integral Coil–Spark Plug".

* cited by examiner

*Primary Examiner*—Anh Mai
(74) *Attorney, Agent, or Firm*—Andrew F. Reish

(57) ABSTRACT

The object of the invention is an ignition component for internal combustion engines.

It comprises:
a secondary winding (4);
high-voltage output means (11–13) for the said secondary winding capable of supplying an ignition spark to a cylinder of an internal combustion engine;
a primary winding (2);
a casing (7) in which are arranged the said windings and the said high-voltage output means; and
holding means for holding the windings and the output means in the casing.

7 Claims, 2 Drawing Sheets

IGNITION COMPONENT FOR INTERNAL COMBUSTION ENGINES

The present invention relates to an ignition component for internal combustion engines and more particularly to such a component comprising a secondary winding and high-voltage output means for the secondary winding which are capable of supplying an ignition spark to a cylinder of an internal combustion engine.

BACKGROUND OF THE INVENTION

Ignition coils are already known which are intended to be mounted on a spark plug in order to supply electricity individually to such spark plug.

From the document EP-A-0 387 993, an assembly is known which is comprised of a spark plug firmly fixed to the secondary high-voltage part of an ignition coil. The primary low-voltage part of this coil is connected above the secondary part. This coil is thus partially fixed to the spark plug and is also intended for its individual supply of power.

However, such an assembly has two disadvantages. On the one hand, it is not unitary since it requires the mounting of the primary part of the coil after it has itself been mounted on the engine unit. And, moreover, it is incompatible with conventional spark plugs.

The present invention aims to overcome these difficulties.

SUMMARY OF THE INVENTION

To this end, it is the object of the invention to provide an ignition component as described above wherein the invention comprises:

a primary winding;

a secondary winding;

a casing in which are arranged the windings and a high-voltage output means; and holding means to hold the windings and the output means in the casing.

These holding means may comprise a resin poured in the casing, or a plugging stopper.

Thus, a unitary member is achieved combining the functions of ignition coils and conventional spark plugs.

More particularly, the high-voltage output means may comprise a ceramic base insulating the conducting means from the casing.

In a particular embodiment of the invention, the primary and secondary windings are directly embedded in the resin.

In another embodiment, the windings are embedded in a first resin prior to their insertion into the other resin.

More particularly, the ignition component in accordance with the invention may comprise a cap of synthetic material between the windings and the high-voltage output means.

The said casing may comprise a covering bonded to an earth element crimped onto a base insulating the high-voltage output means from the casing.

The casing may also form a covering crimped on a base insulating it from the high-voltage output means.

The ignition component in accordance with the invention may comprise a stopper closing the casing at the opposite end from the high-voltage output means.

By way of non-limiting example, a particular embodiment of the invention will now be described with reference to the attached schematic drawings in which:

DETAILED DESCRIPTION OF THE INVENTION

Figure 1:
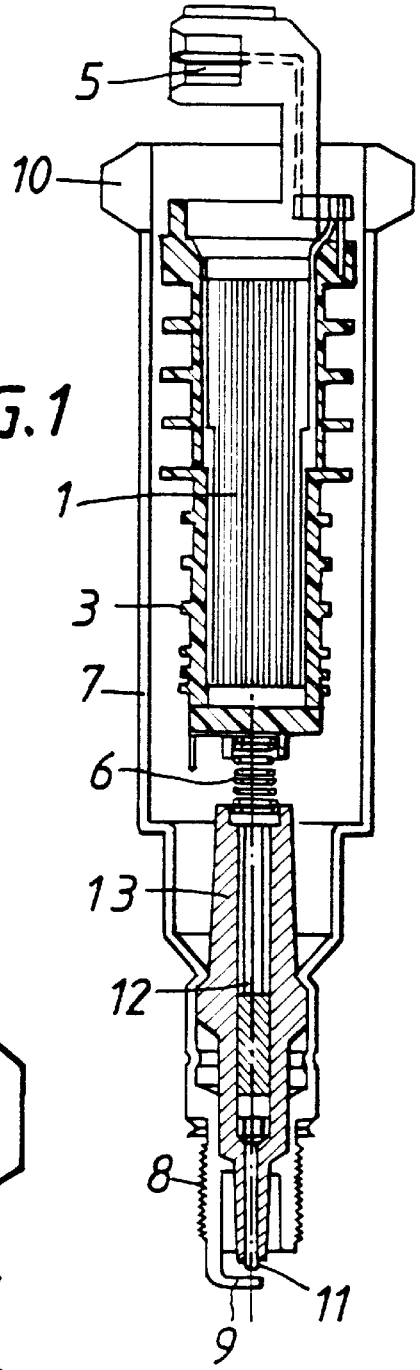
FIG. 1 is an axial cross-sectional view of an ignition component in accordance with a first embodiment of the invention.
Figure 2:
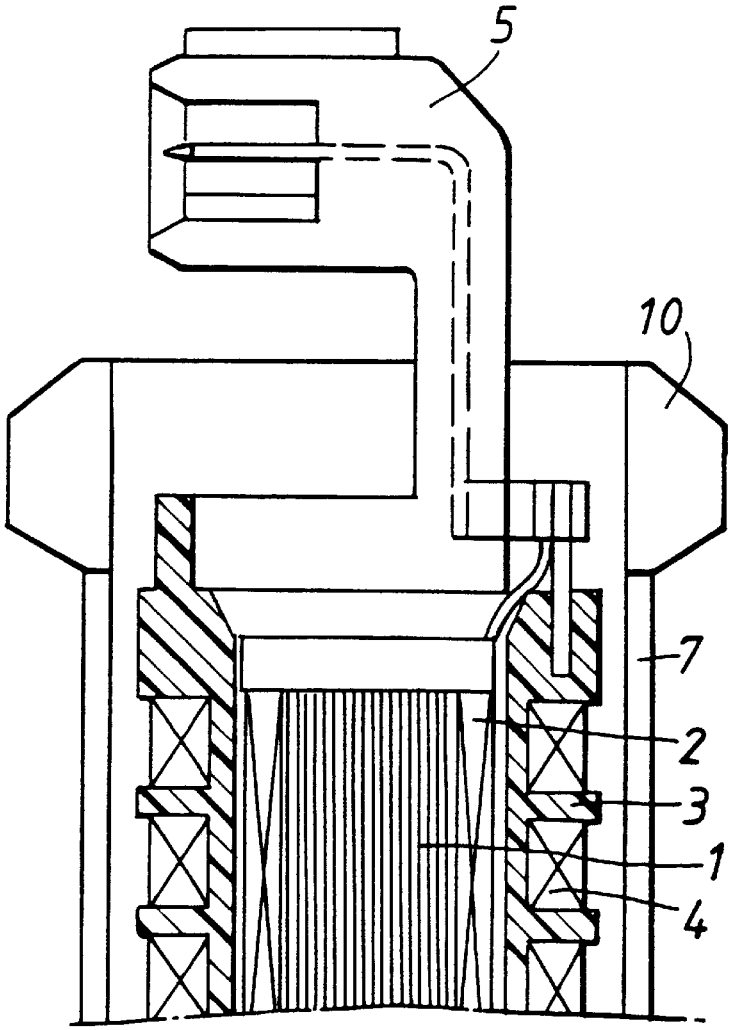
FIG. 2 is a view on a larger scale of the upper part of FIG. 1.

The ignition component of FIG. 1 comprises a magnetic core 1 on which a primary winding 2 is wound. A secondary winding holder 3, in this case of the type with two compartments, is disposed above the primary winding in a concentric manner and receives the secondary winding 4. For the sake of greater clarity, the windings are not illustrated in FIG. 1.

As in a spark plug, the primary winding 2 is supplied from a connector 5 and the high-voltage output of the secondary winding is produced on an output component 6, in this case, a spring.

The "coil" assembly just described is disposed in a casing 7 provided at its end, which is opposite the connector 5, with a thread 8 for mounting on an engine unit, not illustrated, and with an earth electrode 9 similar to that of a spark plug. At its other end, the casing 7 has threaded joint means 10 able to cooperate with a key capable of locking the thread 8 in the corresponding thread of the engine unit.

A high-voltage electrode 11 is mounted in the casing 7 opposite the earth electrode 9 and is connected to the high-voltage output component 6 by an electrically conductive assembly 12. The high-voltage electrode 11 and the conductive assembly 12 are located within a tapering portion of the casing 7 are insulated from the casing 7 by a base 13 produced in a ceramic of the same type as that of spark plugs. The outer surface of the base 13 has a pair of intersecting surface portions which form an engagement portion for receiving a crimped or mating section of the tapering portion.

The assembly of the component in accordance with the invention just described is carried out in the following manner.

The base 13 provided with the high-voltage electrode 11 and the conductive assembly 12 is firstly crimped in the casing 7. The "coil" assembly described above is then, in turn, disposed in the casing with the high-voltage output component 6 in contact with the end of the conductive assembly 12. Finally an insulating resin, not illustrated, is poured in the casing 7 in order to insulate and hold the different parts.

Figure 3:
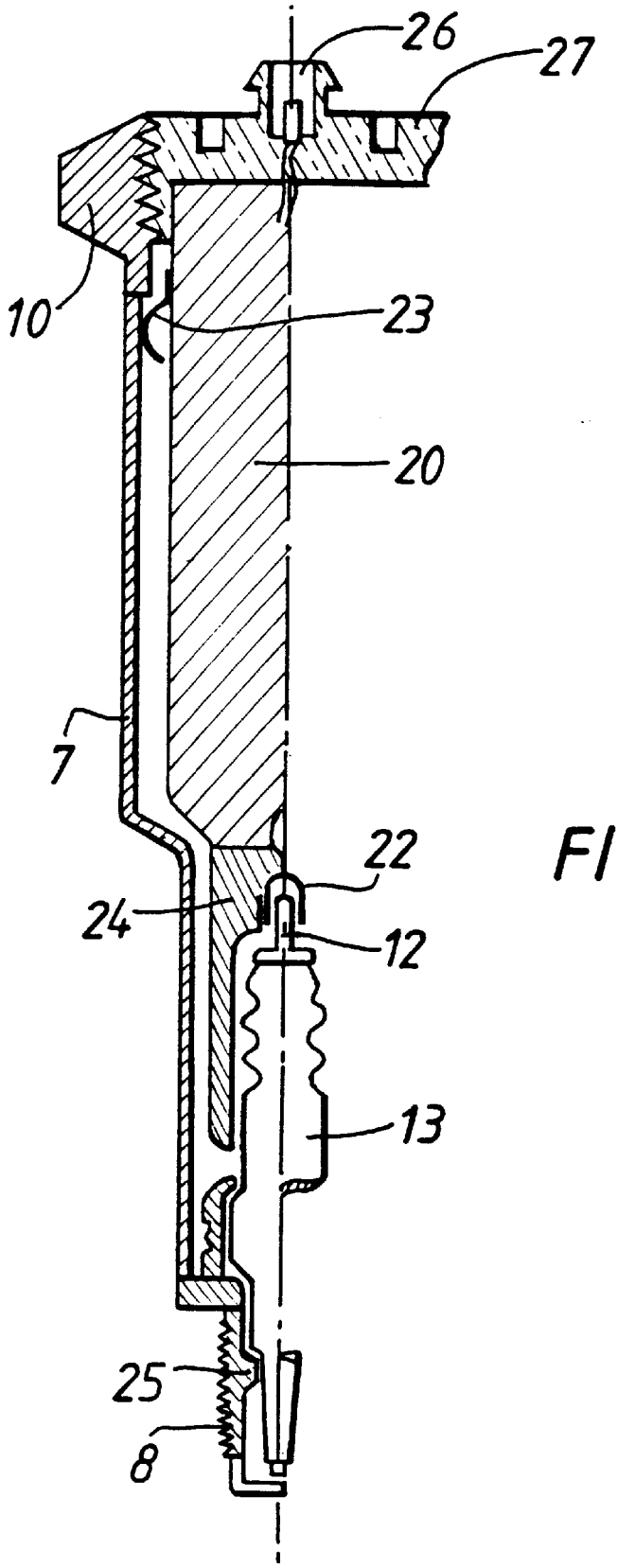
FIG. 3 is a partial view similar to FIG. 1 of a second embodiment.

In FIG. 3, the same reference numbers are used to designate the same parts.

In this case, the "coil" assembly is previously produced in a unitary way and embedded in a resin 20. This assembly is associated, on the side 21 of its high-voltage output, with a connector 22 connecting it to the conductive assembly 12. A connection 23 connects it to earth.

A cap 24 of synthetic material, in particular silicon, provides the seal between the coil assembly and the casing 7.

This casing forms, in this case, a tubular piece bonded on an earth piece 25 in which the base 13 is crimped and comprising the thread 8 described above. A second resin is, in this case, poured between the coil assembly with its own resin 20, and the casing 7.

In this embodiment, the control connector 26, comprising a single or double connection, is mounted on a stopper 27 screwed onto the casing 7, and more particularly, onto the screw joint piece 10.

It will be observed that, in a variation of the embodiment of FIG. 3, the second resin could be omitted, the parts inside the casing being held only by the stopper 27. In such a case, the ignition component would remain detachable.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ignition component for internal combustion engines, comprising:

a primary winding;

a secondary winding;

a high-voltage output means for said secondary winding for supplying an ignition spark to a cylinder of an internal combustion engine;

a ceramic insulating base, said base being an oblong body having a first end surface and a second end surface, and an outer surface extending between said first and second end surfaces, said outer surface having a first surface portion and a second surface portion, said first and second surface portions forming a first engagement portion;

a casing having a hollow interior, a first portion and a tapering portion, said tapering portion extending from an end portion of said first portion, said primary and secondary windings being disposed within said first portion and said base being disposed within said tapering portion;

a single resin case in said casing for embedding, insulating and holding said primary and secondary windings and said output means; and an earth element, wherein said tapering portion has a second engagement portion, said second engagement portion having an outer surface facing away from said base and a radially adjacent inner surface facing toward said base, a portion of said outer surface having a concave shape and a portion of said adjacent inner surface having a convex shape generally corresponding in contour to said concave shape, said portion of said adjacent inner surface contacting said first engagement portion, whereby said casing is engaged onto said base, said base insulating said high-voltage output means from said casing.

2. The ignition component as claimed in claim 1, wherein said high-voltage output means includes a conducting means for conducting output therefrom.

3. An ignition component as claimed in claim 1, wherein said windings are embedded in said resin case prior to their insertion in said casing.

4. An ignition component as claimed in claim 1, including a cap of synthetic material between the said windings and the said high-voltage output means.

5. An ignition component as claimed in claim 1, wherein the said casing forms a covering crimped onto a base, insulating it from the said high-voltage output means.

6. An ignition component as claimed in claim 1, including a stopper closing off the said casing at its opposite end from the said high-voltage output means.

7. The ignition component as claimed in claim 1, wherein said first surface portion and said second surface portion intersect.

* * * * *